US006889683B1

(12) United States Patent
Smith

(10) Patent No.: US 6,889,683 B1
(45) Date of Patent: May 10, 2005

(54) ARCHERY BOW WITH ACCESSORY MOUNTING SYSTEM

(75) Inventor: Allan F. Smith, Tucson, AZ (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 0 days.

(21) Appl. No.: 10/419,313

(22) Filed: Apr. 16, 2003

(51) Int. Cl.[7] ..... F41B 5/00
(52) U.S. Cl. ..... 124/86; 124/87; 124/88
(58) Field of Search ..... 124/23.1, 24.1, 124/25.6, 44.5, 86, 88, 89, 87; 33/265

(56) References Cited

U.S. PATENT DOCUMENTS 4,215,484 A * 8/1980 Lauffenburger ..... 33/265
5,123,396 A * 6/1992 Shepley et al.
5,285,764 A * 2/1994 Mertens
5,331,941 A * 7/1994 Schaffer
5,428,901 A * 7/1995 Slates ..... 33/265
5,442,862 A * 8/1995 Newbold et al.
5,735,053 A * 4/1998 McGunigal

* cited by examiner

*Primary Examiner*—John A. Ricci
(74) *Attorney, Agent, or Firm*—Cahill, von Hellens & Glazer, P.L.C.

(57) ABSTRACT

An archery compound bow having a riser to support accessories is provided with a keyway positioned at the location for attachment of a bracket to support an accessory. The bracket is also provided with a keyway; a key is positioned to nest in the respective keyways when the bracket is attached to the riser. The bracket is secured to the riser using screws or other conventional fastening means with the key extending into the keyways to position the bracket and maintain the position of the bracket on the riser.

10 Claims, 1 Drawing Sheet

ARCHERY BOW WITH ACCESSORY MOUNTING SYSTEM

This invention pertains to compound archery bows and in particular to archery bows combined with accessory mounting systems for mounting accessories such as bow sights, arrow rests and arrow overdraw brackets.

BACKGROUND OF THE INVENTION

Archery bows of the "compound bow" type are generally constructed having a rigid handle member or riser that is formed to accommodate a grip for the archer's hand. The rigid riser terminates at either end with a means for attaching flexible limbs thereto. The limbs, in turn, terminate in cams or wheels to accommodate operating cables and a bow string. Such archery bows are known as compound bows and are presently available in the prior art in a variety of designs usually adapted for specific bow uses such as hunting and the like.

To facilitate the uses of such compound archery bows, it is necessary to attach certain accessory items to the riser to enable the archer to properly use the bow. For example, a bow sight is typically attached to the riser using screws or bolts and provides a means for the archer to aim the arrow to compensate for the variations in the arrow's trajectory as a result of the target range or other shooting conditions. Similarly, accessories such as an overdraw bracket are frequently utilized by archers to permit the archer to "overdraw" an arrow such that the head of the arrow, when drawn, is actually positioned rearwardly of the riser. Such overdraw brackets that permit the archer to "overdraw" are generally used by archers to launch shorter and lighter arrows than the standard arrow to thus increase the velocity of the arrow and flatten the arrow's trajectory on its way to a target.

Other accessories may be attached to the archery bow riser, such as an arrow quiver. The positioning of the accessory brackets is particularly critical to the mounting of a bow sight or the mounting of an overdraw bracket to the riser. To permit the archer to remove the accessories and to reinstall them in precisely the same location, the prior art simply utilizes screws that pass through the respective brackets and engage the threads of mounting holes provided in the riser. The repeatability of the positioning of the brackets is therefore governed by the fit of the screws; dimensional variations that occur as a result of ordinary manufacturing tolerances frequently cause the brackets to be installed in slightly different positions. Similarly, the brackets may be jarred from their position during typical rough handling of a compound archery bow that is used for hunting, or if the bow is dropped and the bracket strikes a hard object. The precise positioning of accessory brackets on archery bow risers has therefore suffered in the prior art as a result of ordinary manufacturing dimensional variations; further, the likelihood that the bracket may be slightly jarred from its desired position as a result of impact adversely affects the repeatability of the bracket positioning. Even slight shifting of the parts relative to each other can cause serious performance degradation, e.g., a slight change in the sight position can radically change the point of impact of the arrow.

Some prior art bow risers are provided with indentations to accept the external shape of an accessory bracket to maintain the bracket in a specific firm position when mounted on the riser (see, for example, the accessory mount described in U.S. Pat. No. 5,123,396). If the owner-archer of such prior art bow riser attempted to use another manufacturer's accessory on such a riser, the configuration of the bracket may not correspond to the indentations provided in the riser and the bracket would therefore not be usable; thus, the accessory to be mounted to that bracket would not be usable in combination with that riser.

OBJECTS OF THE INVENTION

It is therefore an object of the present invention to provide an archery bow incorporating a riser having a means to affix an accessory bracket thereto.

It is another object of the present invention to provide an archery bow having a riser formed with a keyway to facilitate locking an accessory bracket in position when mounted on the bow riser.

It is still another object of the present invention to provide an archery bow with an accessory mounting system wherein accessory brackets and bow risers are provided with keyways to accept a key therebetween when the bracket is mounted on the bow riser to thus secure the bracket in position on the riser and firmly maintain the position of the bracket.

These and other objects of the present invention will become apparent to those skilled in the art as the description thereof proceeds.

SUMMARY OF THE INVENTION

The present invention is an archery bow and accessory mounting system including a conventional compound archery bow wherein the riser of the bow is provided with one or more keyways, each strategically located on the riser at the location of an accessory bracket. Accessory brackets such as a bow sight bracket or an arrow rest overdraw bracket are attached to the bow riser in a conventional manner utilizing screws extending through the respective bracket into threaded holes provided in the riser to accept the screws. The keyways are positioned in the riser in the vicinity of the accessory bracket threaded holes and are adapted to receive respective keys that are inserted into the keyways. Each of the respective accessory brackets is also provided with a corresponding keyway that is in an opposing position with respect to the riser keyway at the location of the respective accessory bracket. The accessory bracket is then positioned such that the keyway in the bracket mates with the key extending from the keyway in the riser and the bracket is thereafter secured in the conventional manner using screws. The accessory bracket, thus secured to the riser, is locked in a specific position and is prevented from moving even if the bracket suffers a blow or is struck by a hard object. Further, the specific positioning resulting from the utilization of the key extending into the respective keyways in the riser and the bracket provide precise repeatability in the mounting of the bracket on the riser. Accessory brackets supplied by other manufacturers may still be mounted in the conventional manner on the riser of the present invention; in the latter case, the key is simply not used and the other manufacturer's accessory bracket is simply mounted to the riser in the conventional prior art manner. Similarly, accessory brackets that are manufactured having a keyway formed therein, may nevertheless be used on non-keyway risers of the prior art by eliminating the key and mounting the bracket in the conventional prior art manner using the typical mounting screws.

BRIEF DESCRIPTION OF THE DRAWINGS

The present invention may more readily be described by reference to the accompanying drawings in which.

DESCRIPTION OF THE PREFERRED EMBODIMENT

Figure 1:
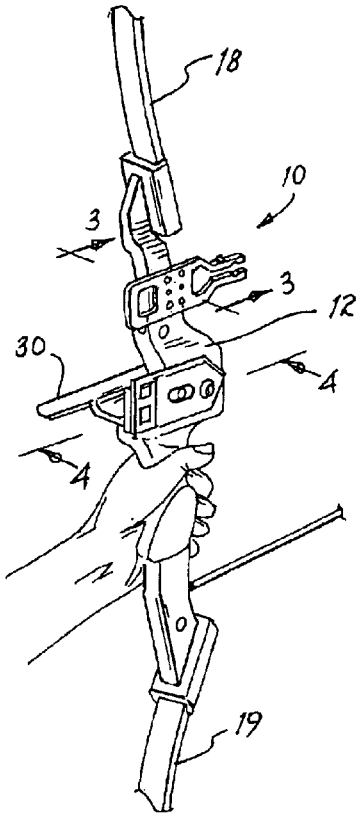
FIG. 1 is a perspective view of an archery compound bow incorporating the teachings of the present invention.
Figure 2:
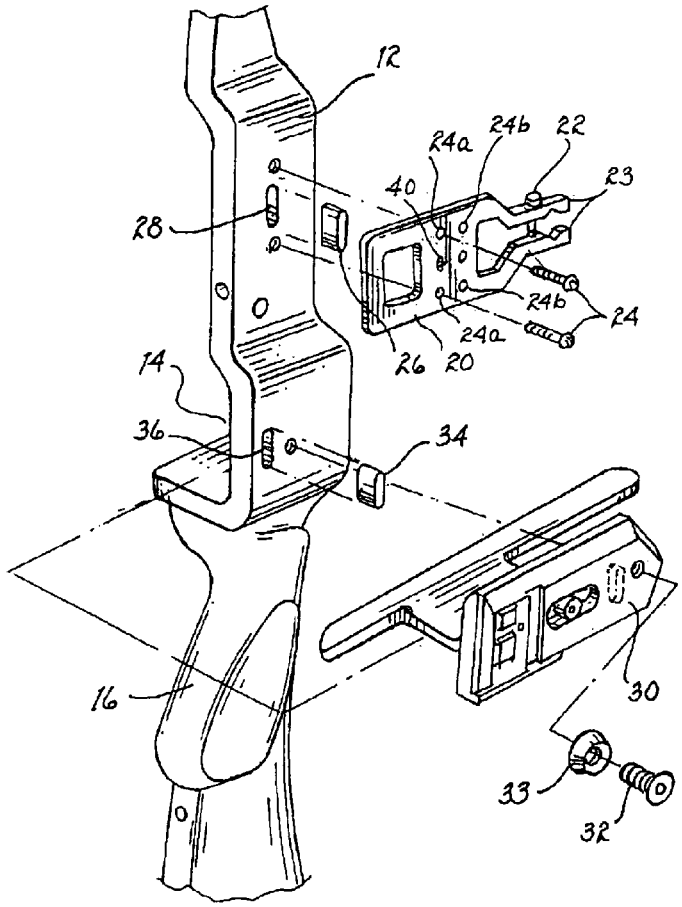
FIG. 2 is an exploded view of a portion of the archery bow of FIG. 1.

Referring to FIGS. 1 and 2, a perspective view and an exploded view of an archery compound bow incorporating the teachings of the present invention is shown. The archery bow 10 incorporates a riser 12 that is conventionally made of aluminum or other strong rigid metal that can be shaped to provide a platform for attachment of accessories and flexible limbs. In the embodiment shown in FIG. 1 flexible limbs 18 and 19 are secured to the respective ends of the riser; the riser also supports a hand grip 16. The flexible limbs are usually formed from fiberglass, carbon fiber, or other material. U.S. Pat. Nos. 4,649,889 and 4,735,667 show a bow limb structure and method form making a bow limb. The grip 16 may be formed of plastic or shaped of wood to provide a comfortable contact surface for the palm of the archer's hand. The riser shown in FIG. 1 incorporates an offset 14 to facilitate the utilization of the archery bow for use with broadhead arrows with an overdraw system.

The riser 12 also forms the basis for mounting a sight bracket 20; the sight bracket is used to secure an archery bow sight to the riser to facilitate the archer's aiming the bow/arrow in a manner well known in the prior art. Such sights typically include provisions for compensating for the trajectory of the arrow in flight. Numerous archery bow sights and similar aiming devices are available in the prior art and therefore need not be described here. Such sights are typically secured to compound bow risers through the use of brackets such as bracket 20. The bow sight may be secured to the sight bracket in a typical manner using sight mounting clamp screw 22 to clamp the bow sight between clamp jaws 23. The sight bracket is secured to the riser 12 through the use of sight bracket screws 24 that extend through holes provided in the bracket and engage threaded holes 25 provided in the riser.

When the sight bracket 20 is mounted on the riser 12, the prior art requires only that the sight screws 24 extend through the holes in the sight bracket into the threaded holes 25 provided in the riser. As mentioned previously, when secured in this manner, ordinary manufacturing dimensional tolerances frequently permit slight variation in the positioning of the bracket. Further, if the bracket is struck by a hard object, it is possible that the bracket will be slightly moved. Since the bracket forms the mount for the archery sight, such slight movement of the bracket adversely affects the sighting or aiming of the bow/arrow. Similarly, if the sight bracket is removed from the riser and subsequently replaced on the riser, the subsequent positioning is seldom precisely the same as the original position. The present invention avoids these deficiencies in the prior art by utilizing a sight bracket key 26 that nests in a sight bracket keyway 28 formed in the riser 12. The keyway 28 is positioned adjacent the threaded holes 25 in the riser, and in a position opposing the sight bracket when the latter is mounted or secured to the riser 12. A corresponding keyway 29 (FIG. 3) is provided in the opposing face of the sight bracket 20. Thus, the present invention eliminates the difficulties presented by prior art mounting bracket systems; that is, when the sight bracket 20 is secured to the riser 12 through the use of the prior art sight bracket screws 24, the sight bracket key 26 nests in the sight bracket keyway 28 formed in the riser and in a corresponding keyway 29 formed in the sight bracket 20. As the sight bracket screws 24 are tightened, the sight bracket key nests in the respective keyways and is "wedged" firmly in place to maintain the precise positioning of the sight bracket 20 with respect to the riser 12.

The sight bracket 20 may subsequently be removed and then replaced without a variation or change in the respective positions of the bracket. The manufacturing tolerances described above in connection with the prior art bracket mounting systems is irrelevant in the system of the present invention. The key firmly positions the bracket with respect to the riser and maintains the bracket in that predetermined position regardless of the manufacturing tolerances of the bracket, riser, bracket screws or threaded riser holes. The bracket mounting system of the present invention may accommodate mounting brackets of other manufacturers that do not incorporate keyways. Under such circumstances, the bracket is secured to the riser in the conventional prior art manner by simply attaching the bracket and securing it to the riser using the bracket screws. Further, the bracket of the present invention incorporating the keyway may be used on other bow risers that may not incorporate the sight bracket keyway; again, in such circumstances, the bracket is mounted to the bow riser using the conventional prior art screws. Thus, the system of the present invention permits interchangeability of accessory brackets with archery bow risers by simply eliminating the use of the key and mounting the bracket in a conventional prior art manner. However, if the desired fixed alignment of the bracket with the bow riser is desired, and the advantages of the present invention are desired, a keyway is provided in a bow riser and in the sight bracket as described above, and the key is utilized to maintain precise positioning of the bracket and in the avoidance of bracket movement in response to blows or other sharp forces.

Figure 3:
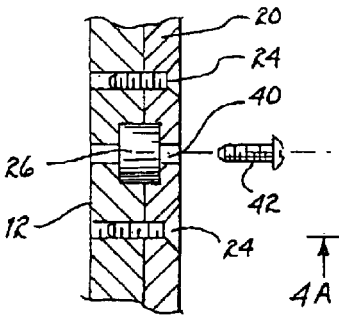
FIG. 3 is a cross-sectional view of FIG. 1 taken along line 3—3.

To provide fore-and-aft adjustability in the mounting of the sight bracket 20 with respect to the riser 12, the sight bracket may be provided with more than one keyway to accept the sight bracket key 26. Fastening screws may be passed through the bracket 20 through holes 24*a* provided therein to align a first keyway (such as shown in FIG. 3) with the keyway provided in the risers. Alternatively, the bracket may be adjusted horizontally by inserting the bracket screw 24 through the holes 24*b* provided in the bracket 20 thereby positioning the bracket closer to the archer. It may be possible to utilize several keyways formed in the sight bracket 20 to permit adjustment of the horizontal positioning of the sight bracket so that the bracket key 26 nests into the sight bracket keyway 28 formed in the riser and into a selected one of the keyways (such as keyway 29 in FIG. 3) formed in the sight bracket 20.

In a manner similar to the sight bracket described above, an arrow rest overdraw bracket 30 may be secured to the riser 12 using the conventional mounting screw 32, overdraw bracket washer 33 and the threaded mounting hole 35. An overdraw bracket keyway 36 is formed in the riser 12 to receive an overdraw bracket key 34. When the arrow rest overdraw bracket 30 is attached to the riser 12, the overdraw bracket key 34 nests and wedges in the keyway 36 and a corresponding keyway 37 formed in the overdraw bracket 30.

It may be noted that the arrow rest overdraw bracket 30 incorporates a unique shape 39 that may be utilized to engage a correspondingly shaped indentation (not shown) in the riser 12. See for example the description of this technique in U.S. Pat. No. 5,123,396. However, in the system of the present invention, such unique shape is not required and the arrow rest overdraw bracket 30 is mounted as shown in FIG. 1 and secured to the riser 12 through the use of a single mounting screw 32 engaging a corresponding threaded hole 35 in the riser. The precise positioning and the maintenance of that precise position is achieved by the overdraw bracket key 35 nesting and wedging into the keyways 36 and 37. Accessory brackets may therefore be mounted on the riser 12, subsequently removed, and then replaced without affecting the positioning of the brackets. Such repeatability is very important for the maintenance of accuracy of the bow/arrow operation.

Referring to FIG. 3, a cross-sectional view of a portion of FIG. 1 is shown wherein it may be seen that the riser 12 is provided with threaded holes 25 to receive corresponding sight bracket screws 24. The sight bracket key 26 is wedged into the respective keyways provided in the riser 12 and sight bracket 20. FIG. 3 discloses the use of release openings 40 together with a release device such as a self-tapping screw 42 to facilitate the removal of the key 26 from the keyways in a manner to be described more fully hereinafter.

Figure 4:
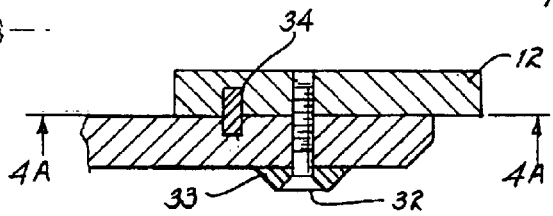
FIG. 4 is a cross-sectional view of FIG. 1 taken along line 4—4.
Figure 4A:
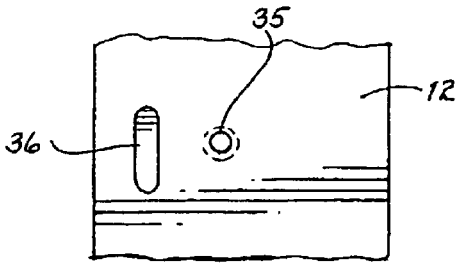
FIG. 4A is a sectional view of FIG. 4 taken along line 4A—4A.

Referring now to FIG. 4, the mounting screw 32 is shown passing through the overdraw bracket washer 33, through the arrow rest overdraw bracket 30 into the riser 12. The overdraw bracket key 34 is shown wedged into the respective keyways in the riser 12 and the bracket 30. The keyway 36 in the riser 12 is more clearly shown in FIG. 4A; further, the positioning of the keyway 36 in relation to the threaded mounting hole 35 provided in the riser is also shown more clearly in that figure.

Figure 5:
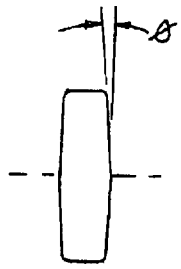
FIG. 5 is a cross-sectional view of a key suitable for use in the system of the present invention.
Figure 6:
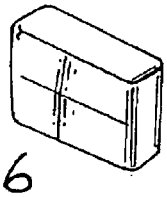
FIG. 6 is a perspective view of the key of FIG. 5.

Referring to FIGS. 5 and 6, a suitable key for use in the system of the present invention is shown, the key 50 may be formed in any conventional manner and may use typical machine-type key construction and configuration. However, the particular configuration shown in FIGS. 5 and 6 is preferred. This configuration lends itself to either machine formed metal keys or to molded plastic keys. In either instance, the longitudinal sides of the key 50 are provided with a slight taper having an angle θ to provide a "wedging" action as the key is inserted into the respective keyway. The particular angle utilized for the angle θ will vary depending on the particular material with which the key is to be constructed; however, it is intended that the angle merely provides a slight "wedging" action in the keyway in the accessory mount and in the bow riser. In this manner, the relative position of the bracket on the riser is rigidly maintained. Other key configurations may be used instead of the rectangular box form shown. For example, cylindrical keys formed like pegs may be advantageous in certain circumstances—easy to manufacture and the keyway is easy to create. However, the preferred form of the key ism that shown in FIGS. 5 and 6.

When the bracket is to be removed from riser 12, it is possible, and even likely, that the key will be retained in one of the receiving keyways; that is, the wedging action of the key in the respective keyways will tend to make the key bind in one of the keyways such that when the bracket is removed the key will remain firmly wedged into one of the keyways. To facilitate the removal of the key from the keyway, a release opening 40 (FIGS. 2 and 3) is provided that extends through the riser 10 or the respective bracket 20 or 30. This release opening may be a small hole that is pre-drilled and extends from an outer surface of the riser or respective bracket and also extends into the keyway provided therein. A release device such as a self-tapping screw 42 may then be used by inserting the screw into the respective release opening 40 and advancing the screw into abutting contact with the key. Additional rotation of the screw after such abutting contact will thus force the key out of the keyway. In this manner, keys used in systems of the present invention may readily be removed even though they may tend to remain "wedged" in one of the keyways. The archer may choose to us a small diameter punch or drift inserted into the release opening to remove any key that may be retained by the corresponding keyway.

In an alternative embodiment of the present invention, the key may be removably attached to one of the members. That is, the key could be removably attached to the accessory bracket (such as by attaching with a removable screw). The bracket would therefore not require a keyway, and the riser would be the only member to require a keyway. In this manner, only a single keyway need be formed, and the key may simply be attached to the other member. When the members are secured to each other, the key extends into the keyway as described above, and performs its intended function to keep the members in secure positional relationship. The key may be removed simply by unscrewing it from the bracket, and the bracket may then be used as in the prior art on other risers. Similarly, the key could be removably attached to the riser, and only the bracket would need to be provided with a keyway.

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

I claim:

1. An archery compound bow having a riser, said riser including a threadless keyway formed therein; a pair of flexible limbs extending from said riser; an accessory bracket for supporting an archery bow accessory and having a threadless keyway formed therein, said bracket removably secured to said riser; a threadless key removably positioned in the threadless keyways in said riser and in said bracket and held in said threadless keyways while said bracket is secured to said riser.

2. The combination set forth in claim 1 wherein said accessory bracket is a bow sight bracket.

3. The combination set forth in claim 1 wherein said accessory bracket is an arrow rest overdraw bracket.

4. An archery compound bow having a riser, a pair of flexible limbs extending from said riser; an accessory bracket for supporting an archery bow accessory, said bracket removably secured to said riser; a threadless keyway formed in one of said riser and bracket and a threadless key removably secured to the other of said riser and bracket; said threadless key extending into said threadless keyway while said bracket is secured to said riser.

5. The combination set forth in claim 4 wherein said accessory bracket is a bow sight bracket.

6. The combination set forth in claim 4 wherein said accessory bracket is an arrow rest overdraw bracket.

7. An archery compound bow having a riser, said riser including a keyway formed therein; a pair of flexible limbs extending from said riser; an accessory bracket for supporting an archery bow accessory and having a keyway formed therein, said bracket removably secured to said riser; a key removably positioned in the keyways in said riser and in said bracket and held in said keyways while said bracket is secured to said riser; means for extracting said key from one of said keyways including an opening extending into said one of said keyways to permit an object to be inserted therein for contacting said key.

8. The apparatus set forth in claim 7 wherein said means for extracting said key includes a self-tapping screw for insertion into said opening to contact said key and force said key from said keyway as said screw is threaded into said opening.

9. The combination set forth in claim 7 wherein said accessory bracket is a bow sight bracket.

10. The combination set forth in claim 7 wherein said accessory bracket is an arrow rest overdraw bracket.

* * * * *